US011772299B2

(12) United States Patent
Scardovi et al.

(10) Patent No.: US 11,772,299 B2
(45) Date of Patent: Oct. 3, 2023

(54) METHOD AND MACHINE FOR THE SURFACE DECORATION OF A CERAMIC ARTICLE

(71) Applicant: SACMI COOPERATIVA MECCANICI IMOLA SOCIETA' COOPERATIVA, Imola (IT)

(72) Inventors: Stefano Scardovi, Imola (IT); Claudio Ricci, Imola (IT); Andrea Bresciani, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 83 days.

(21) Appl. No.: 16/611,823

(22) PCT Filed: May 16, 2018

(86) PCT No.: PCT/IB2018/053434
§ 371 (c)(1),
(2) Date: Nov. 7, 2019

(87) PCT Pub. No.: WO2018/211435
PCT Pub. Date: Nov. 22, 2018

(65) Prior Publication Data

US 2020/0139578 A1 May 7, 2020

(30) Foreign Application Priority Data

May 16, 2017 (IT) ..... 102017000053047

(51) Int. Cl.
*B28B 11/00* (2006.01)
*B28B 11/04* (2006.01)
(Continued)

(52) U.S. Cl.
CPC ..... *B28B 11/001* (2013.01); *B28B 11/049* (2013.01); *B28B 11/06* (2013.01);
(Continued)

(58) Field of Classification Search
CPC ..... B28B 11/00; B28B 11/001; B28B 11/04; B28B 11/041; B28B 11/048;
(Continued)

(56) References Cited

U.S. PATENT DOCUMENTS 6,387,457 B1 * 5/2002 Jiang ..... B05D 5/06 427/163.1
2015/0298492 A1 * 10/2015 Palumbo ..... B05D 3/065 427/558

FOREIGN PATENT DOCUMENTS

CN 101 407 089 A 4/2009
EP 2065150 A1 * 6/2009 ..... B28B 1/005
(Continued)

OTHER PUBLICATIONS

"Hotmelt Adhesives" from Polymer Properties Database, as evidence of ethylene-vinyl acetate being a thermoplastic polymer (Year: 2015).*

(Continued)

*Primary Examiner* — Francisco W Tschen
*Assistant Examiner* — Edgaredmanuel Troche
(74) *Attorney, Agent, or Firm* — Workman Nydegger

(57) ABSTRACT

A method and machine for the surface decoration of a basic article comprising ceramic material and having a surface and a printing assembly applies an adhesive material digitally and selectively onto a defined area of the surface. A treatment assembly deposits a powder material digitally and selectively in the defined area, and the powder material in excess arranged on the basic article is removed.

19 Claims, 7 Drawing Sheets

(51) Int. Cl.

| | |
|---|---|
| ***B28B 11/06*** | (2006.01) |
| ***B05C 19/04*** | (2006.01) |
| ***B41M 3/00*** | (2006.01) |
| ***B41M 7/02*** | (2006.01) |

(52) U.S. Cl.
CPC ..... *B05C 19/04* (2013.01); *B41M 3/006* (2013.01); *B41M 7/02* (2013.01)

(58) Field of Classification Search
CPC ..... B28B 11/049; B28B 11/06; B28B 1/005; B05D 5/06; B41J 3/407; B05C 19/02; B05C 19/04; B05C 19/008; B44C 1/00; B44C 1/105; B41M 5/007
USPC ..... 427/258, 287; 156/291
See application file for complete search history.

(56) References Cited

FOREIGN PATENT DOCUMENTS

| | | | | | |
|---|---|---|---|---|---|
| EP | 2 892 657 | B1 | | 11/2016 | |
| RU | 2433037 | C2 | | 11/2011 | |
| WO | 2006/051238 | A1 | | 5/2006 | |
| WO | 2009/118611 | A1 | | 10/2009 | |
| WO | WO-2009118611 | A1 | * | 10/2009 | ..... C04B 41/4545 |
| WO | 2014/037823 | A1 | | 3/2014 | |

OTHER PUBLICATIONS

MacMillan, J. H. "Formulating Silicone Adhesives Gels and Sealants," (2011) (Year: 2011).*
International Search Report and Written Opinion dated Sep. 5, 2018 from International Patent Application No. PCT/IB2018/053434 filed May 16, 2018.

* cited by examiner

METHOD AND MACHINE FOR THE SURFACE DECORATION OF A CERAMIC ARTICLE

PRIORITY CLAIM

This application claims priority from Italian Patent Application No. 102017000053047, filed on 16 May 2017, the disclosure of which is incorporated by reference.

TECHNICAL FIELD

The present invention relates to a method and machine for the surface decoration of a basic article comprising ceramic material. Furthermore, the present invention relates to a method and system for manufacturing ceramic articles.

BACKGROUND OF THE INVENTION

Machines in the field of manufacturing ceramic articles (specifically, slabs; more specifically, tiles) for the surface decoration of a basic article are known.

In detail, a machine is known, which comprises a printing assembly adapted to apply an adhesive material selectively in a defined area of a surface of the article, so as to create a sort of pattern on the article itself. The machine is further provided with a deposition device, which deposits a powder material over the entire surface. The powder material deposited in the defined area remains attached to the adhesive material, where the powder material arranged in other areas of the stated surface is removed.

This type of machine has several drawbacks, including the following.

The powder material is used in considerable excess. This can lead to a significant waste of material or the need for complex and costly technical measures for a massive recirculation of material. Recirculation systems wear out easily.

The recovery of the powder material also causes granulometry changes or possibly clusters due to traces of glue.

The use of combinations of different materials is only possible by installing various machines on the line.

Furthermore, with these types of machines, obtaining shades of different colors (for example gray scale) is practicably impossible or nonetheless extremely complicated and costly.

A machine is also known for the surface decoration, comprising a treatment assembly, which deposits the powder material directly (without the prior application of glue) onto the defined area of the surface of the article, so as to create a sort of pattern on the article itself.

However, these machines are also not without drawbacks, including the following. Unfortunately, the treatment assemblies, which are currently available, are unable to produce patterns with particularly high resolution. Furthermore, the patterns obtained are imprecise and present flaws and inconsistencies with respect to the desired patterns.

EP2892657 describes a method and machine for the digital decoration of products with granular materials.

It is an object of the invention to provide a method and machine for the surface decoration of a basic article comprising ceramic material, and a method and plant for producing ceramic articles, which allow the drawbacks of the prior art to be overcome, at least partially and which are both cheap and easy to make.

SUMMARY

A method and machine are provided according to the present invention for the surface decoration of a basic article comprising ceramic material, and a plant for producing ceramic articles according to what is stated in the following independent claims and, preferably, in any one of the claims dependent directly or indirectly on the independent claims.

BRIEF DESCRIPTION OF THE FIGURES

The invention is described below with reference to the appended drawings, which illustrate some non-limiting embodiments, wherein.

DETAILED DESCRIPTION

Figure 1:
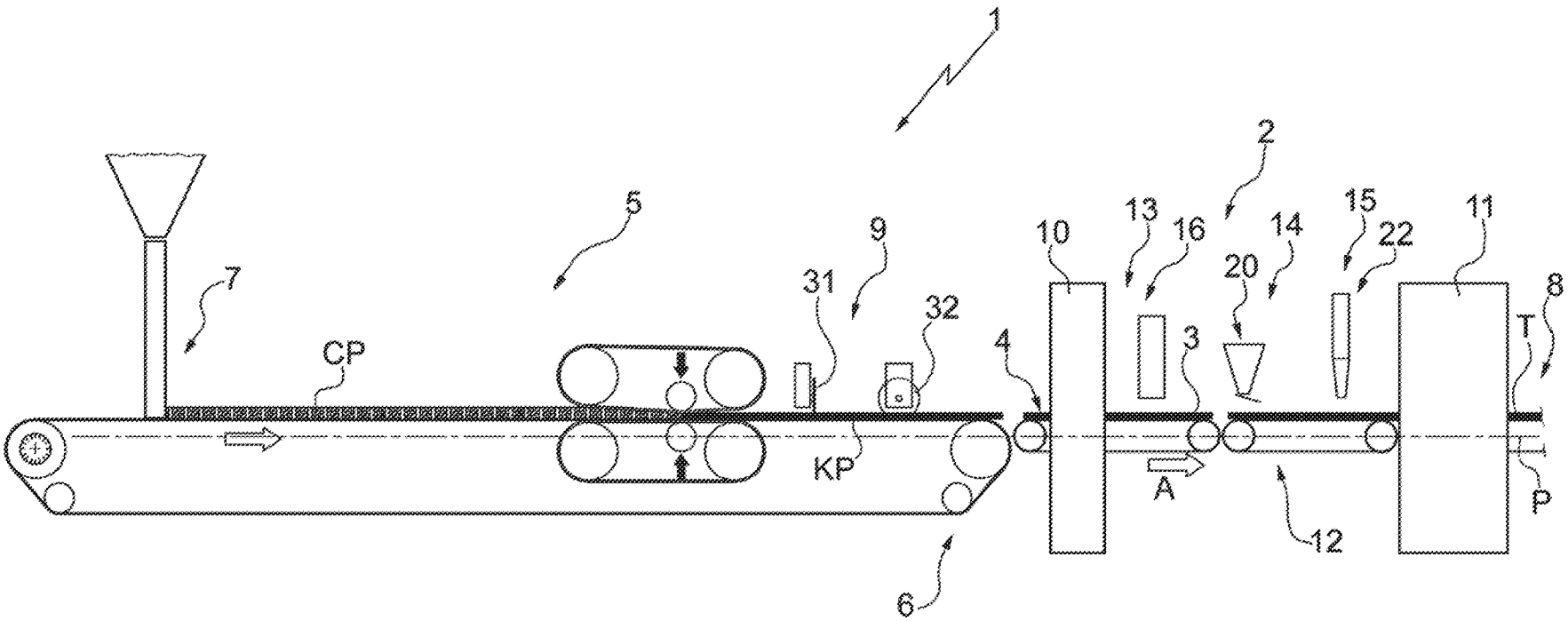
FIG. 1 is a schematic side view of a plant according to the present invention.

A plant for producing a ceramic product T is globally indicated with 1, in FIG. 1. In particular, the ceramic product T is a slab (more precisely, a tile).

The plant 1 comprises a machine 2 for the surface decoration of a basic article 3, comprising ceramic material and having at least a surface 4; a compacting machine 5 for compacting a powder material CP comprising ceramic powder so as to obtain a layer of compacted powder KP; and a conveying assembly 6, which is adapted to feed (in a substantially continuous manner) the powder material CP along a given path P from an inlet station 7 to the compacting machine 5 and the layer of compacted powder KP from the compacting machine 5 to the decoration machine 2 (and to an outlet station 8). In particular, the compacting machine 5 and the machine 2 are arranged along the path P between the inlet station 7 and the outlet station 8. More specifically, the machine 2 is arranged downstream of the compacting machine 5.

In particular, the basic article 3 comprises (at least) a portion of the layer of compacted powder KP.

According to some non-limiting embodiments, the plant 1 comprises at least a cutting assembly 9 for transversely cutting the layer of compacted powder KP so as to obtain the basic article 3, which has a portion of the layer of compacted powder KP. In particular, the cutting assembly 9 is arranged along the path P (more specifically, downstream of the compacting machine 5 and upstream of the machine 2). Advantageously, but not necessarily, the conveying assembly 6 is adapted to feed the layer of compacted powder KP to the cutting assembly 9 and transport the basic article 3 downstream of the cutting assembly 9 (through the machine 2).

According to some non-limiting embodiments, the plant 1 further comprises a drier 10 arranged along the path P downstream of the compacting machine 5 (more specifically, downstream of the cutting assembly 9) and upstream of the machine 2.

According to some non-limiting embodiments, the plant 1 also comprises a firing kiln 11 for sintering (the layer of compacted powder KP) of the basic article 3 so as to obtain a ceramic product T. In particular, the firing kiln is arranged along the given path P downstream of the machine 2 (and downstream of a removal station 15, described below in further detail).

According to some non-limiting and non-illustrated embodiments, the plant 1 does not comprise the compacting machine 5 and the cutting assembly 9 but it comprises a traditional pressing machine (of a known type) for tiles. Typically, such pressing machine is provided with a vertical axis hydraulic pressing device adapted to press ceramic material into powder so as to obtain single slabs (which do not require cutting) of pressed material directly.

The machine 2 comprises a conveying device 12 (which is, in particular, part of the conveying assembly 6) for conveying (with substantially continuous movement) the basic article 3 along the given path P through an application station 13 and a work station 14 (arranged downstream of the application station 13). According to some embodiments, the conveying device 12 is also adapted to convey the basic article 3 through the removal station 15 (in particular, arranged along the path P downstream of the work station 14).

The machine 2 further comprises a printing assembly 16, which is arranged in the application station 13 and adapted to apply (digitally) an adhesive material 17 (for example, see FIGS. 5, 9, 12 and 13) to the surface 4. In particular, the printing assembly 16 is adapted to apply the adhesive material 17 selectively at least in a defined area 18 of the surface 4 so that at least a further area 19 (in particular, different from the defined area 18) of the surface 4 is left without adhesive material 17.

The machine 2 also comprises a treatment assembly 20, which is arranged in the work station 14 and adapted to deposit (digitally) a powder material 21 (in particular, on the adhesive material 17) selectively in the defined area 18 of the surface 4 so as not to cover at least part of the further area 19 of the surface 4.

The fact that the adhesive material 17 (which, in particular, is not necessarily sticky and serves to help keep at least part of the powder material 21 on the basic article 3) and the powder material 21 are present on the surface 4 at the same time makes it possible to reduce the risks of the powder material 21 moving on the basic article 3. This advantage is particularly evident when the powder material 21 is deposited on the adhesive material 17, which is already present on the surface 4.

According to some non-limiting embodiments (see FIGS. 1-11), the machine 2 comprises a removal device 22, which is arranged in the removal station 15 and adapted to remove the powder material 21 in excess (in other words, not bound to the adhesive material) present on the basic article 3.

In particular, the powder material comprises (more precisely, is composed of) a ceramic material.

According to some non-limiting embodiments, the powder material comprises (more specifically, is composed of) particles with sizes ranging from 50 to 500 μm (more precisely from 100 to 500 μm).

The sizes of the particles are obtained by means of successive sieving using sieves with holes of decreasing sizes (diameters). The diameter of the holes of the first sieve, which does not allow the passage of the particles, indicates the sizes (or rather diameter) of the particles.

The measurements by means of successive sieving are performed until the sizes (or rather, the diameters) of the particles and the holes of the sieves allow (in particular, up to a minimum of 0.05 mm).

Advantageously, but not necessarily, the printing assembly 16 comprises at least an ink-jet head (ink-jet—known in itself and not illustrated), which is adapted to emit one or more jets of adhesive material towards the surface 4. For example, the printing assembly 16 is as described in patent application EP703863. In particular, the head is, in some specific cases, a piezoelectric ink-jet head; for example, the Dimatix StarFire™ SG1024 (by Fujifilm®) or Xaar® 1003 GS40.

Advantageously, but not necessarily, the removal device comprises a suction unit 22' for sucking the powder material 21 in excess (in other words, not bound to the surface 4 by means of the adhesive material 17). More precisely, the suction unit 22' is structured so that, in use, the powder material 21 is removed by means of upward suction. In particular, the suction unit 22' comprises a downward-facing suction mouth.

Suction allows (for example, with respect to blowing) a reduction in the risks of the powder material 21 reaching non-desired areas of the surface 4.

According to some non-limiting embodiments (see FIGS. 8 to 11), the treatment assembly 20 comprises a deposition device 23 and at least a deposition device 24. In particular, the deposition device 23 is adapted to deposit a first type of the powder material 21 (such type is represented in FIGS. 8-11 with dots of reduced sizes) (selectively) in a first part of the defined area 18; the deposition device 24 is adapted to deposit a second type of the powder material (different from the first type of powder material and represented in FIGS. 8-11 with larger dots than those of the first type) (selectively) in a second part of the defined area 18 different from the first part of the defined area 18.

More precisely, in some cases, the deposition device 23 is adapted to deposit the first type of the powder material 21 selectively in the first part of the defined area 18 and not in the second part of the defined area 18; the second deposition device 24 is adapted to deposit the second type of the powder material 21 selectively in the second part of the defined area 18 and not in the second part.

In particular, the first and the second type of powder material 21 differ from each other in their mechanical/physical characteristics and/or color.

According to specific, non-limiting embodiments (like the one illustrated in FIGS. 2 and 3), the treatment assembly 20 (more precisely, each deposition device 23 and 24) has a front face 33 in which the powder material 21 is discharged.

In embodiments, as illustrated in FIGS. 8-11, the front faces 33 of the deposition devices 23 and 24 are facing each other (in opposite directions). In this way, the time between the two applications of the powder material 21 is reduced.

Figure 14:
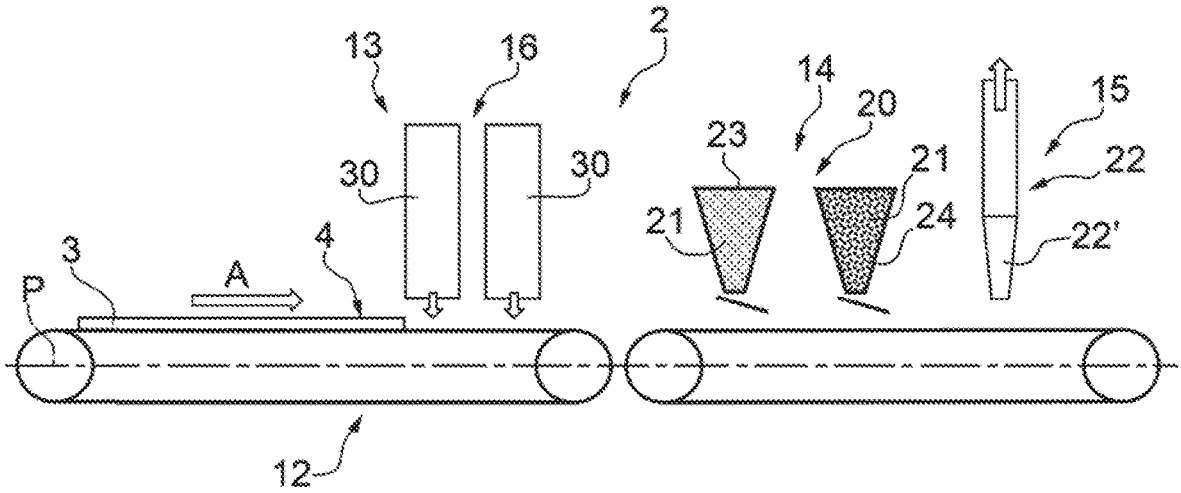
FIG. 14 is a schematic side view of a different embodiment of the part of the plant in FIGS. 4 to 7.

According to the embodiment illustrated in FIG. 14, the front faces 33 of the deposition devices 23 and 24 are facing in the same direction (in particular, in an advancing direction A).

By having two (or more) deposition devices 23 and 24, it is possible to obtain combinations of two (or more) types of powder material 21 on the surface 4 in a relatively simple manner. In this way, it is possible to create special esthetic effects, such as, for example, combinations of different colors and/or different shades (for example different shades of grays).

In this regard, note that, alternatively, or in addition to the above, the first and the second type of powder material 21 can be deposited in a same part of the defined area 18 (in varying quantities). In this way, for example, it is possible to obtain shades of different colors.

According to some non-limiting and non-illustrated embodiments, the removal device 22 comprises a further suction unit arranged between the deposition devices 23 and 24.

According to some non-limiting and non-illustrated embodiments, the machine 2 comprises, in series, in the advancing direction A and along the path P, the printing assembly 16 (provided with an application device 30), the treatment assembly 20 (provided with a deposition device 23), the removal device 22, a further printing assembly (substantially the same as the printing assembly 16), a further treatment assembly (substantially the same as the treatment assembly 20) and a further removal device (substantially the same as the removal device 22).

Advantageously, but not necessarily, the machine 2 also comprises a control unit 25 (illustrated in FIG. 4), which is adapted to control the printing assembly 16 (digitally) so that the printing assembly 16 itself applies the adhesive material 17 so as to reproduce a pattern defined on the surface 4. The control unit 25 is adapted to control the treatment assembly 20 (digitally) so that the treatment assembly 20 itself deposits the powder material 21 so as to reproduce a further pattern defined on the surface 4 itself.

In particular, the pattern and the further pattern are memorized in the control unit.

Advantageously, but not necessarily (as illustrated, for example, in FIGS. 13*c*) and 12*c*)), the pattern and the further pattern coincide. In these cases, the distribution of the powder material 21 on the surface 4 can appear greater than that of the adhesive material 17 since the treatment assembly 20 is more imprecise than the printing assembly 16 and, in use, a quantity of powder material 21 is advantageously deposited slightly in excess with respect to what is required (in order to reduce the risk of areas, in which powder material 21 is beneficial, being left without the desired quantity).

In particular, the conveying device 12 is adapted to convey the basic article 3 through the work station 14 in an advancing direction A.

Figure 2:
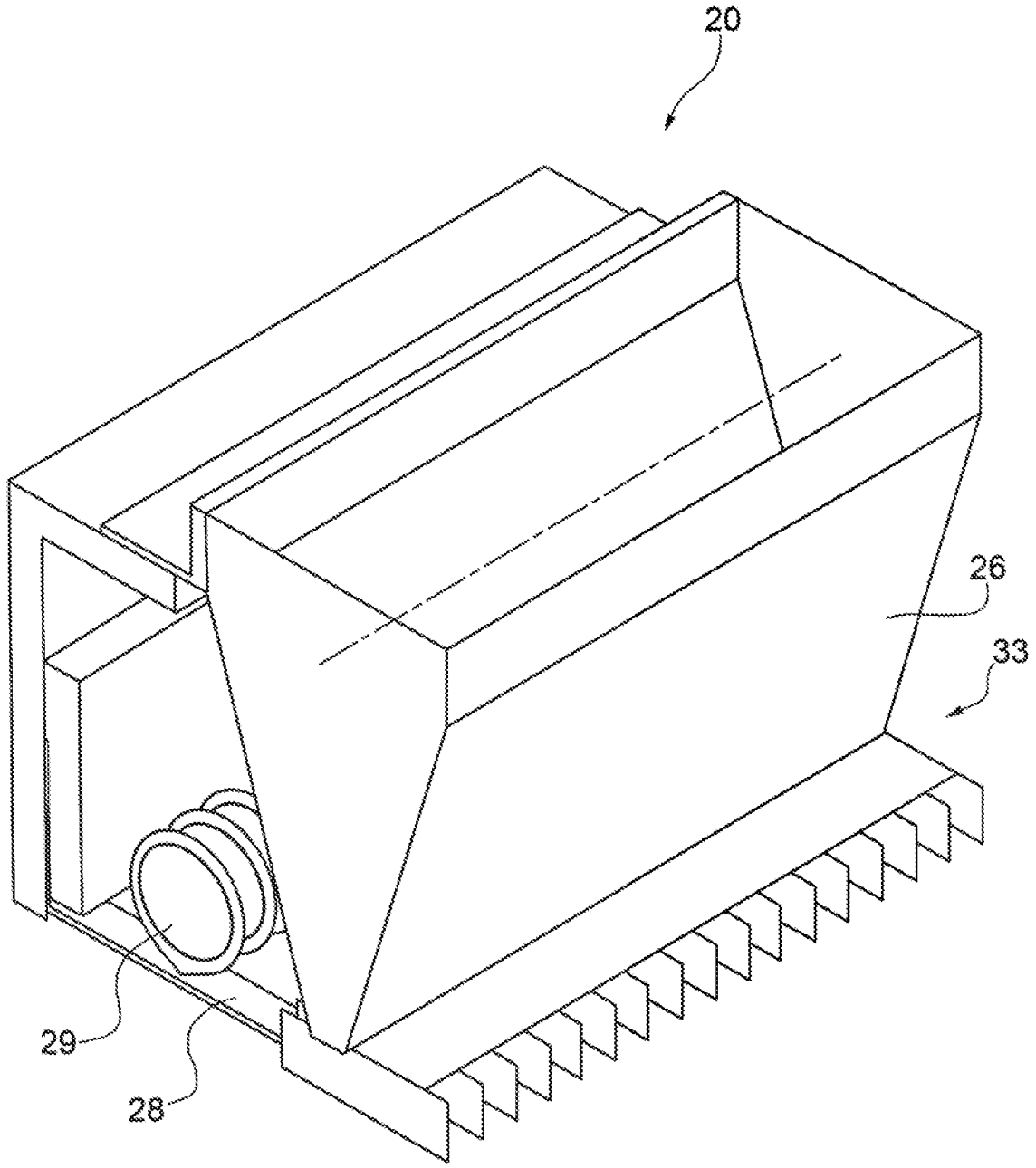
FIG. 2 is a perspective schematic view of a detail of the plant in FIG. 1.
Figure 3:
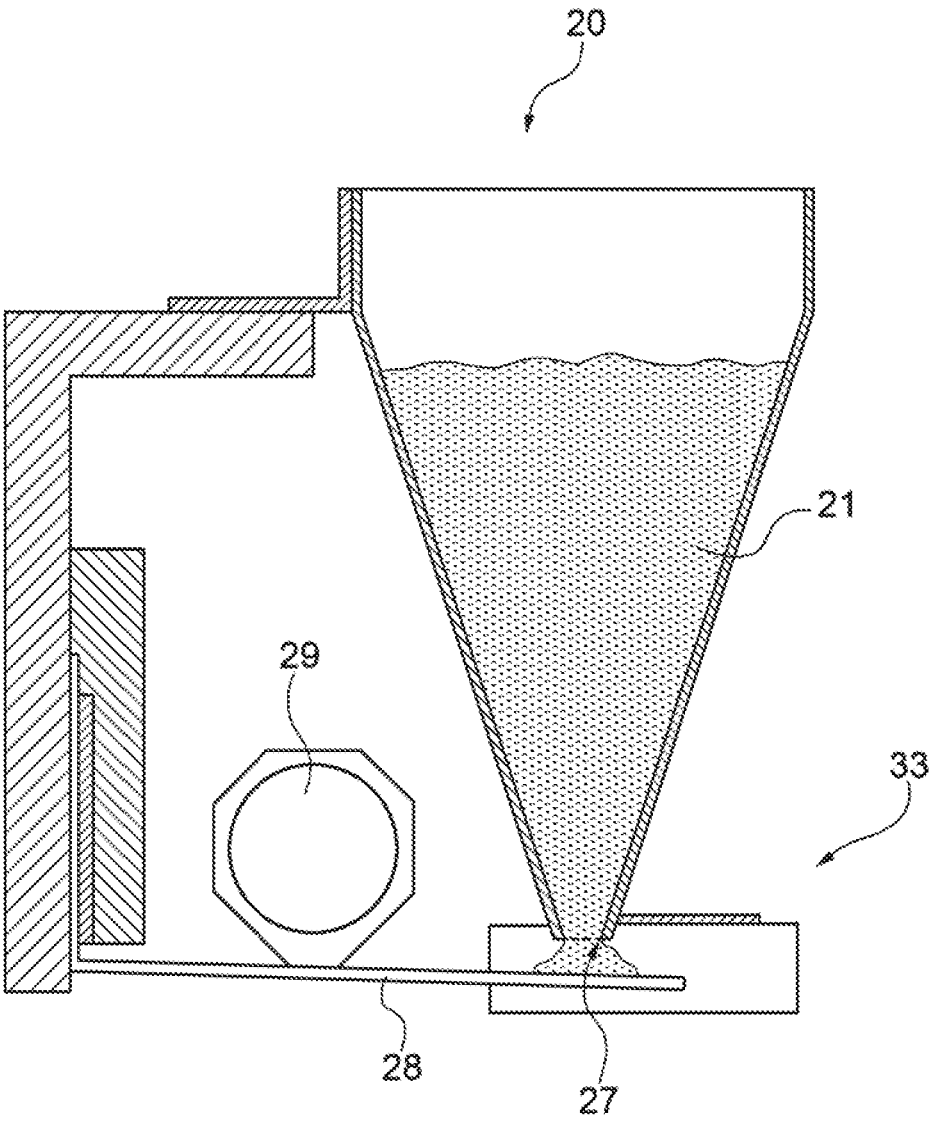
FIG. 3 is a side section of the detail in FIG. 2.
Figure 4:
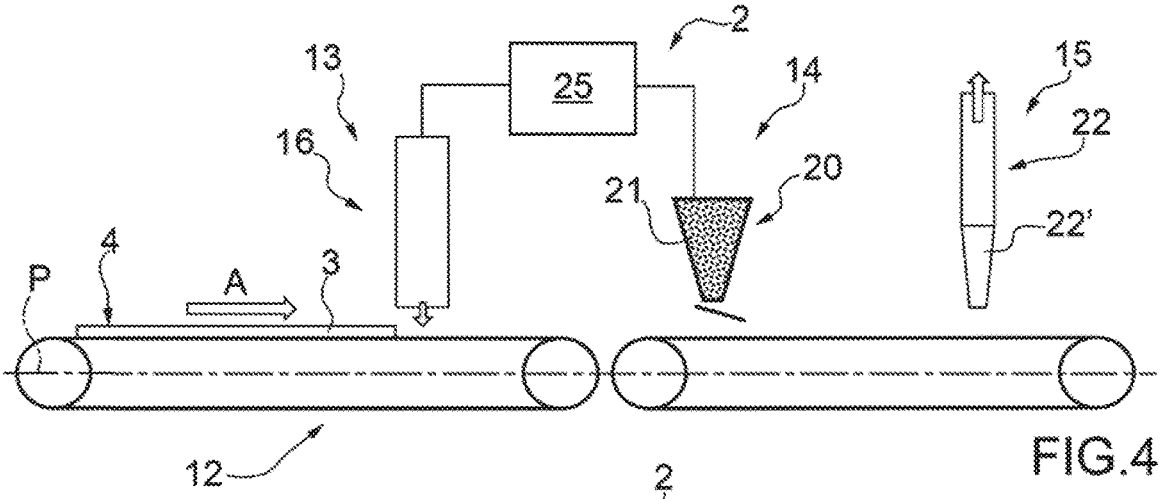
FIGS. 4 to 7 are schematic side views of consecutive steps of operation of a part of the plant in FIG. 1.
Figure 5:
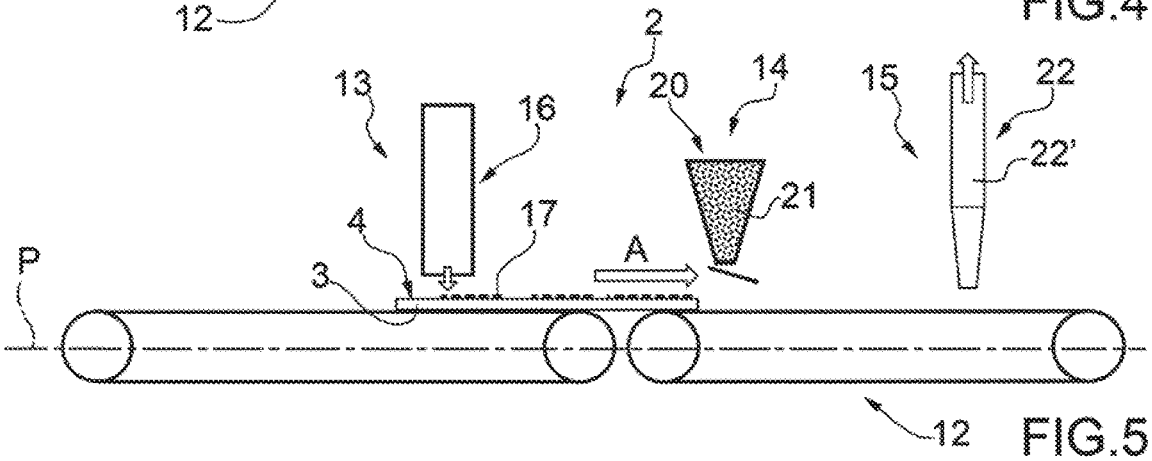
Figure 6:
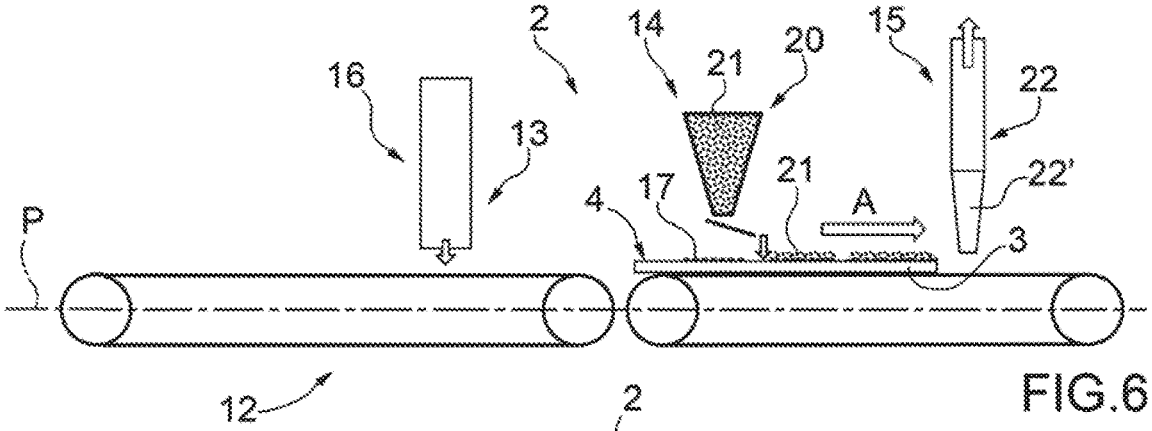
Figure 7:
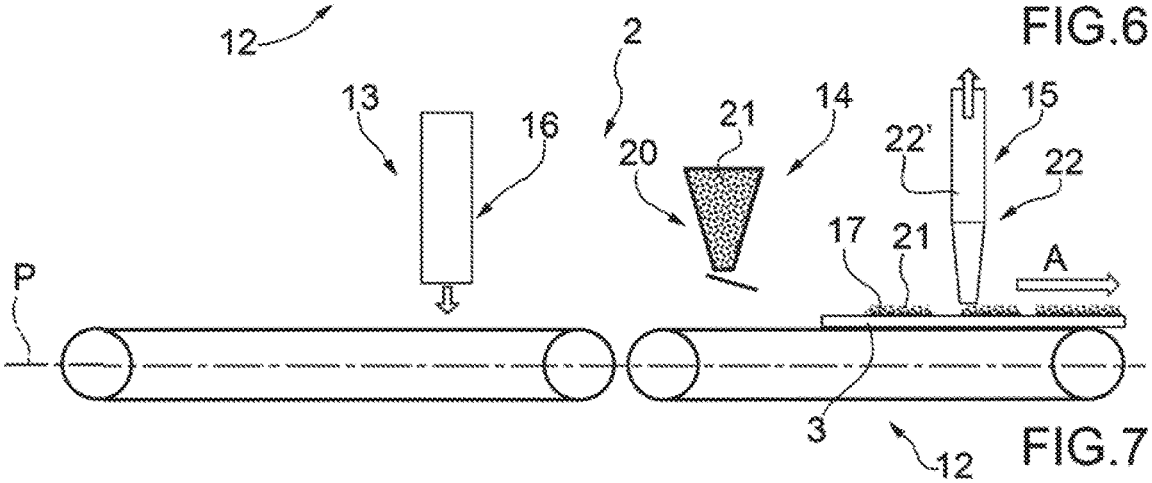
Figure 8:
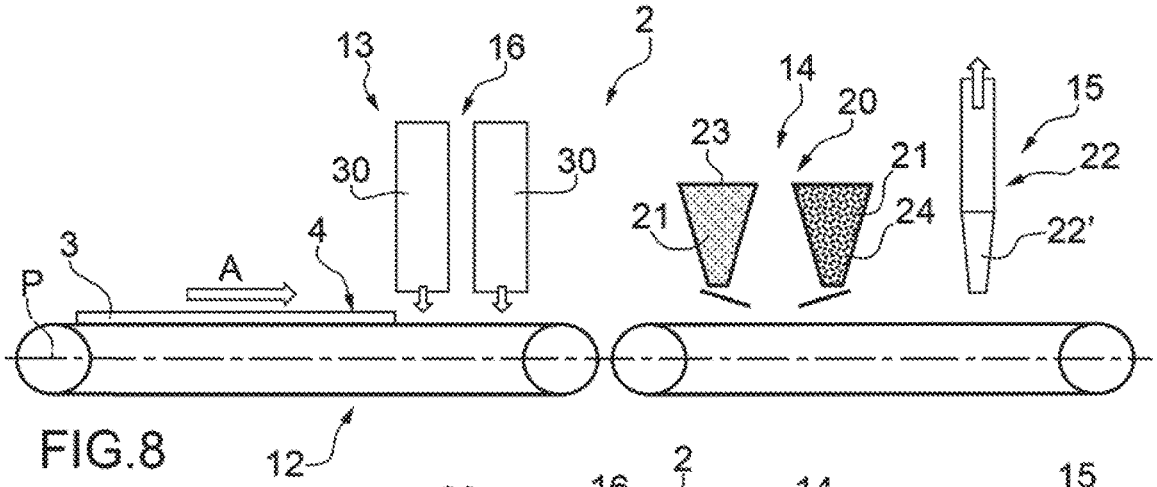
FIGS. 8 to 11 are schematic side views of consecutive steps of operation of a different embodiment of the part illustrated in FIGS. 4-7.
Figure 9:
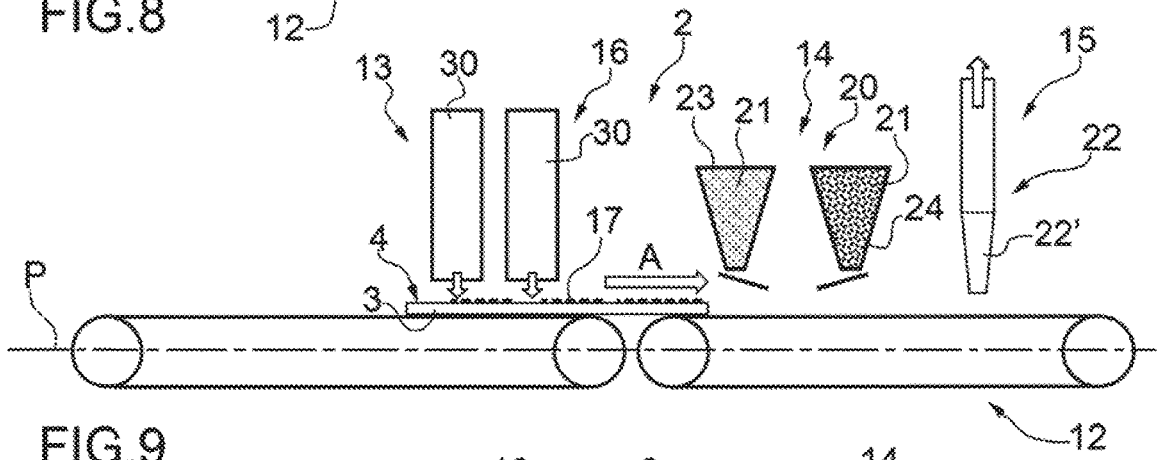
Figure 10:
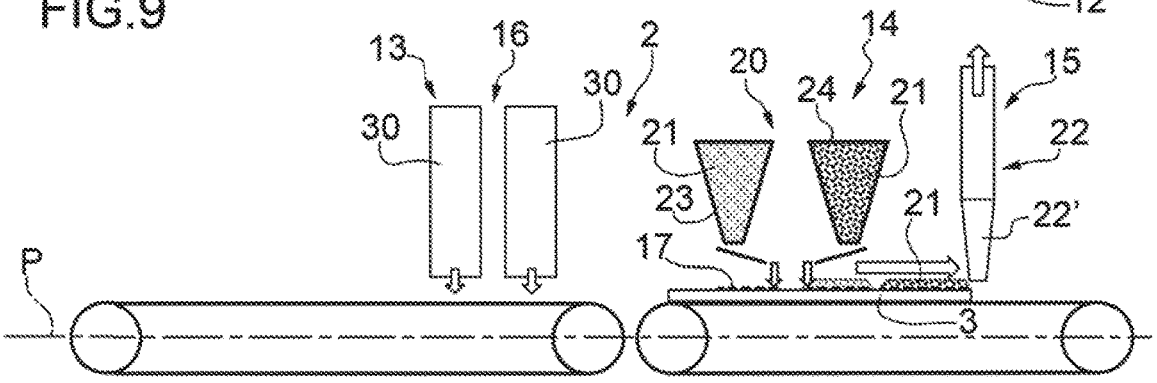
Figure 11:
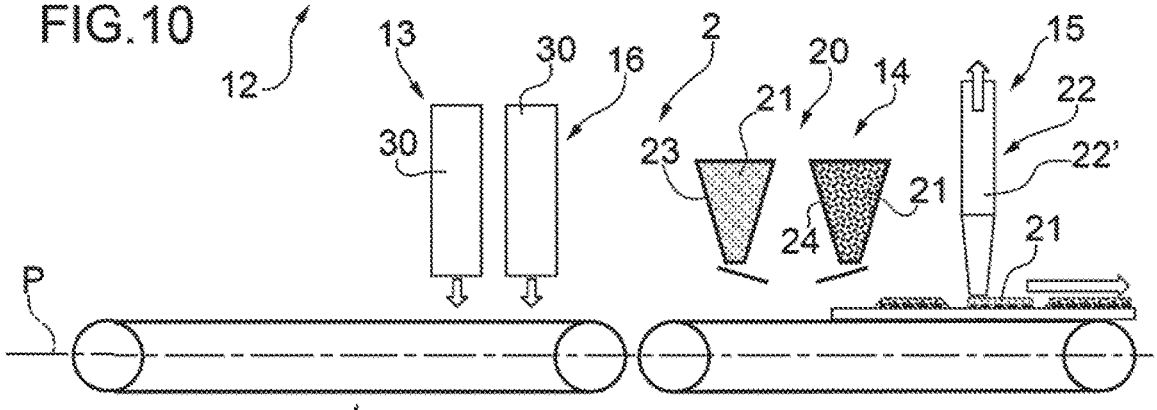

According to some non-limiting embodiments (FIGS. 2 and 3), the treatment assembly 20 (more precisely, each deposition device 23 and 24) comprises at least a container (in particular, a hopper), which is adapted to contain the powder material 21 and has an outlet mouth 27, whose longitudinal extension is transversal (in particular, perpendicular) to the advancing direction A; a plurality of distribution members 28 (fingers) (only one of which is illustrated in FIGS. 2 and 3), which are arranged in series along the outlet mouth 27 (so as to close the outlet mouth 27 itself); and a plurality of actuators 29, each of which is adapted to move a respective distribution member 28 (independently of the other distribution members 13) between a closed position, wherein the respective distribution member 28 blocks the passage of the powder material 21 through the area of the outlet mouth 27 in which it is arranged, and an open position, in which the respective distribution member 28 allows the passage of the powder material 21 through the area of the outlet mouth 27 in which it is arranged.

According to some non-limiting embodiments, the treatment assembly 20 is as described in patent application WO2009118611 (by the same applicant) and/or in patent IT1314623.

According to some non-limiting embodiments (FIGS. 8-11), the printing assembly 16 comprises at least two application devices 30, which are independent of each other and each of which is adapted to emit one or more jets of adhesive material 17 onto said surface 4. In particular, each application device 30 comprises at least a respective ink-jet head.

The presence of two application devices 30 allows the movement of the basic article 3 to be sped up along the path P and thus increase the productivity/efficiency of the machine 2 (and/or of the plant 1).

In the embodiment illustrated in FIGS. 8-11, the application devices 30 are arranged upstream of the deposition devices 23 and 24. According to some non-limiting and non-illustrated embodiments, one of the two application devices 30 is arranged between the deposition devices 23 and 24 and applies, onto the surface 4, the adhesive material 17 onto which the second type of powder material 21 is deposited.

According to some non-limiting embodiments (for example, the one illustrated in FIG. 1), the cutting assembly 9 comprises a cutting blade 31, which is adapted to come into contact with the layer of compacted ceramic powder KP to cut it, and a handling unit (known in itself and not illustrated), to move the cutting blade 31 along a transversal trajectory (more precisely, diagonal) to direction A. In this way, it is possible to provide the basic article 3 with end edges, which are substantially perpendicular to direction A, while the layer of compacted ceramic powder KP is advanced with continuous movement.

Advantageously, but not necessarily, the cutting assembly 9 also comprises two further blades 32, which are arranged on opposite sides of the path P and adapted to cut the layer of compacted ceramic powder KP and define side edges of the basic article 3, which are substantially perpendicular to the end edges (and substantially parallel to direction A). In some specific cases, the cutting assembly 9 is like the one described in the patent application, with publication number EP1415780.

In accordance with to a further aspect of the present invention, a method is also provided for the surface decoration of the basic article 3 comprising ceramic material and having at least the surface 4.

Advantageously, but not necessarily, the method is implemented by the machine 2 described above.

The method comprises a conveying step, during which the basic article 3 is conveyed along a given path P through an application station 13 and a work station 14 (arranged downstream of the application station); an application step, during which a printing assembly 16 arranged in the application station 13 applies (digitally) an adhesive material 17 to the surface 4; a deposition step (which follows, at least partially, the application step), during which a treatment assembly 20 (in particular, as defined above) arranged in the work station 14 deposits (digitally) a powder material 21 (onto the adhesive material 17) selectively in a defined area 18 of the surface 4 so as not to cover at least part of a further area 19 (different from the defined area 18) of the surface 4 itself.

In particular, during the conveying step, a conveying device 12 (in particular, as defined above) conveys the basic article 3 along the given path P through the application station 13, the work station 14 and the removal station 15.

Advantageously, but not necessarily, during the deposition step, the treatment assembly 20 deposits the powder material 21 slightly in excess with respect to the quantity effectively needed.

According to some non-limiting embodiments, the adhesive material (which is not, in particular, necessarily sticky and serves to help keep at least part of the powder material 21 on the basic article 3) comprises (more precisely, is composed of) mixtures containing glycols (such as DEG or PEG), esters (for example, esters of fatty acids), acetates (for example, methyl acetate or ethyl acetate), vinyl acetates, poly-alcohol (such as poly vinyl alcohol), etc.

Additionally, or alternatively, according to some non-limiting embodiments, the adhesive material is chosen from the group consisting of: a substantially stable material (in particular a composition), which does not significantly modify its characteristics in contact with air and at temperatures at least between 15° C. to 60° C., a thermoplastic material (in particular, a composition), which hardens at room temperature, a composition with at least a component absorbable by the basic article 3, a curable material (composition), which is adapted to harden in contact with a hardener (present in the powder material 21), and a combination thereof. In particular, the adhesive material is chosen from the group consisting of: the thermoplastic material (in particular, the composition), the curable material and a combination thereof.

In particular, the adhesive material (more precisely, the substantially stable material) is such as not to evaporate significantly (after being applied to the basic article 3—between the application step and the deposition step).

If the adhesive material comprises (in particular, is, a curable composition, the powder material 21 comprises a hardener (for example, a peroxide) for the curable composition.

Advantageously, but not necessarily, the adhesive material is adapted to be applied by means of an ink-jet head (piezoelectric).

Advantageously, but not necessarily, the adhesive material comprises, in particular, is, the substantially stable material (in particular, the composition).

According to some advantageous, non-limiting embodiments, the adhesive material (more precisely, the substantially stable material) is partially absorbed by the basic article 3 (between the application step and the deposition step).

According to some non-limiting embodiments, the adhesive material comprises, in particular, is, the thermoplastic material (in particular, the composition).

According to some non-limiting embodiments, the adhesive material comprises, in particular, is, the composition with at least a component absorbable by the basic article 3.

According to some non-limiting embodiments, the adhesive material comprises, in particular is, the curable material (the composition).

According to specific, non-limiting embodiments, the substantially stable material comprises (in particular, consists of) paraffinic or esterified oils and at least a ground inorganic enamel and dispersed in such oils. For example, the substantially stable material is SDS VIK M6 by Ferro®.

According to specific, non-limiting embodiments, the thermoplastic material is a Hot-Melt type material and, in particular, comprises (in particular, is) a mixture of EVA (Ethylene Vinyl Acetate), paraffin waxes and styrene oligomers (Bergeron, V., Bonn, D., Martin, J. Y. and Vovelle, L., Controlling droplet deposition with polymer additives, Nature, 405, 772-775 (2000); Le, H. P., Progress and Trends in Ink-jet Printing Technology, J. Image Sci. Tech., 42, 49-(1998); Verschueren, M., A Diffuse-Interface Model for Structure Development in Flow, Ph.D. thesis, Eindhoven University of Technology, the Netherlands (1999).

According to specific, non-limiting embodiments, the composition with at least an absorbable component comprises (in particular, is) an aqueous or alcoholic solution of Polyvinyl Alcohol (for example Mowiol® by Kuraray®) and/or Polyvinyl Acetates (for example ®Mowital LP BX 860 by Kuraray®)

According to specific, non-limiting embodiments, the curable composition comprises (in particular, is) at least an unsaturated resin (more precisely, a mixture of unsaturated resins). In particular, the unsaturated resin is a polyester resin (with acrylic groups). In some non-limiting cases, the unsaturated resin comprises styrene groups. The curable composition can be Water Clear Polyester Casting Resin by Easy Composites™ (Easy Composites Ltd, Unit 39 Park Hall Business Village, Longton, Stoke on Trent. ST3 5XA; Web. www.easycomposites.co.uk.).

According to some non-limiting and non-illustrated embodiments, during the application step, the printing assembly 16 applies the adhesive material 17 over the entire surface 4.

Advantageously, but not necessarily, during the application step, the printing assembly 16 applies the adhesive material 17 selectively in the defined area 18 of the surface 4 so that at least the further area 19 of the surface 4 is left without adhesive material 17.

In particular, during the conveying step, the basic article 3 is conveyed along the given path P through a removal station 15 (arranged downstream of the work station). More specifically, the method also comprises a removal step (which follows, at least partially, the deposition step), during which the powder material 21 in excess (in other words, not bound to the adhesive material) arranged on the basic article 3 is removed in the removal station 15.

Advantageously, but not necessarily, during the deposition step, the treatment assembly 20 deposits a first type of the powder material 21 (selectively) in a first part of the defined area 18, and a second type of the powder material 21 (selectively) in a second part of the defined area 18 (at least partially) different from the first part of the defined area 18 itself.

According to some non-limiting embodiments, the treatment assembly 20 deposits the first type of the powder material 21 (selectively) in the first part of the defined area 18 and not in the second part of the defined area 18; the treatment assembly 20 deposits the second type of the powder material 21 (selectively) in the second part of the defined area 21 and not in the first part.

According to some non-limiting embodiments, the treatment assembly 20 deposits a first type of the powder material 21 (selectively) in at least the first part of the defined area 18; the treatment assembly 20 deposits a second type of the powder material 21 (selectively) in at least the first part of the defined area 18. In these cases, in particular, a quantity of the first type of the powder material 21 is comprised to be deposited, which is not sufficient to cover the entire first part of the defined area 18. More precisely, the second type of the powder material 21 sticks to the adhesive material 17 where there isn't a sufficient quantity of the first type of the powder material 21. In this way, for example, it is possible to obtain different shades of color and/or special esthetic effects.

In particular, the powder material comprises a (consists of) ceramic material.

In some cases, the powder material comprises (more in particular, is composed of) particles with sizes ranging from 50 to 500 μm.

According to some non-limiting embodiments, during the application step, the printing assembly 16 applies the adhesive material 17 by means of the emission of at least a jet of the adhesive material 17 itself. In particular, the printing assembly 16 comprises an ink-jet head, which emits one or more jets of the adhesive material 17 towards the surface 4.

Advantageously, but not necessarily, during the removal step, the powder material 21 in excess (not bound to the adhesive material) is removed by means of suction.

According to some non-limiting embodiments, during the application step, the printing assembly 16 applies the adhesive material 17 onto the surface digitally (in particular, it is controlled digitally) so as to reproduce, on the surface 4, a defined pattern (by a control unit 25); during the deposition step, the treatment assembly 20 deposits the powder material 21 digitally (in particular, it is controlled digitally) so as to reproduce, on the surface, a further defined pattern (by a control unit 25).

In some cases, the pattern and the further pattern coincide.

Figure 13:
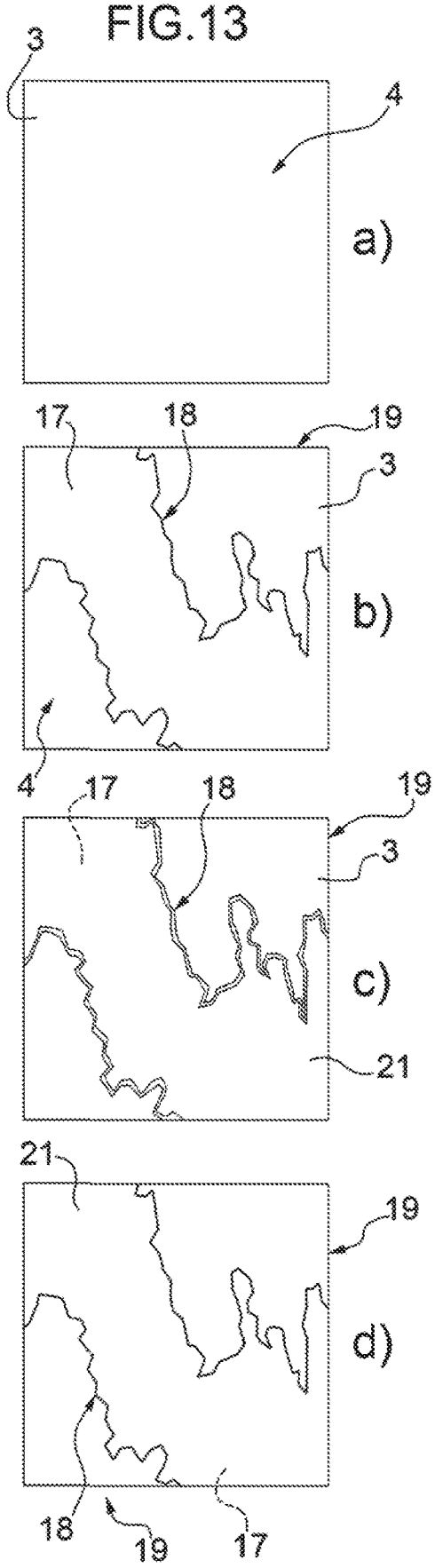
FIG. 13 *a*)-*d*) are plan views of the basic article shown in FIG. 12 *a*)-*d*), respectively.
Figure 12:
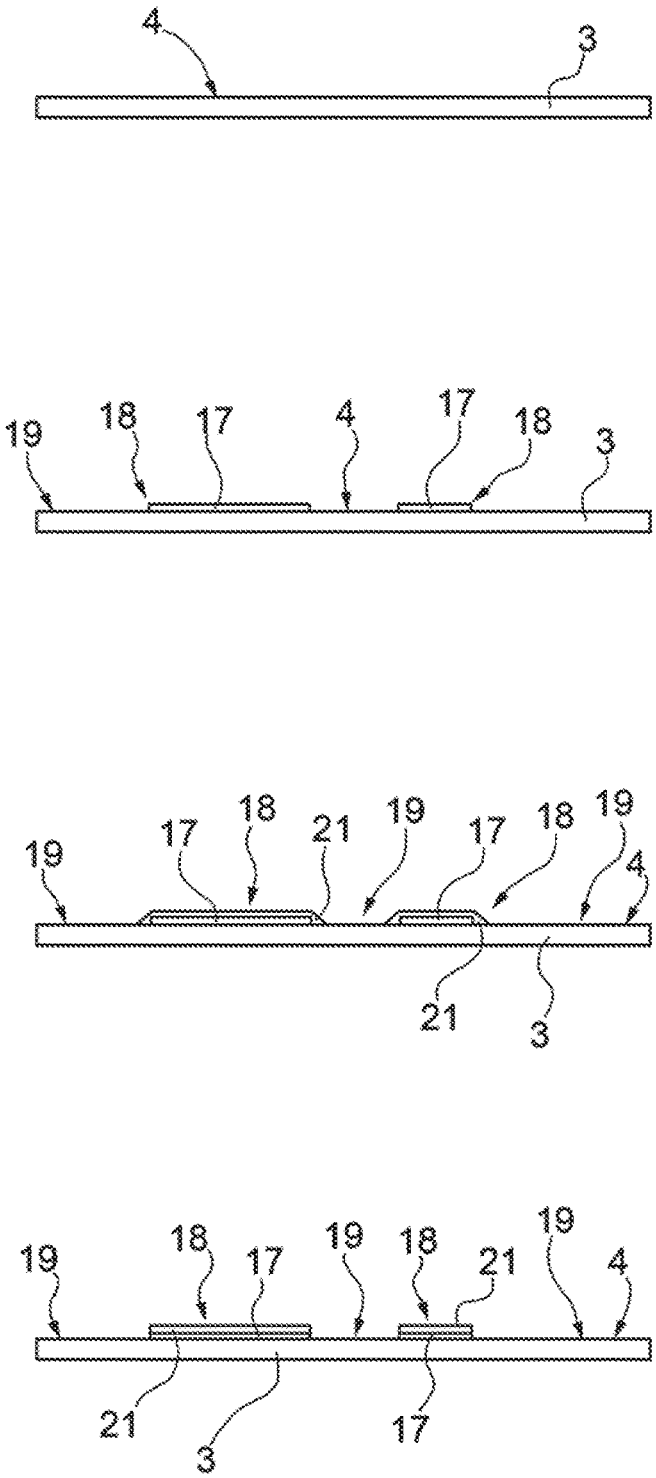
FIG. 12 *a*)-*d*) are side views of a basic article during the various steps illustrated in FIGS. 4-7.

The method described above is illustrated, with particular reference to the treatments carried out on the basic article 3, by way of example in FIGS. 12 and 13. More precisely, FIGS. 12*a*) and 13*a*) illustrate the basic article 3 still to be treated; FIGS. 12*b*) and 13*b*) illustrate the basic article 3 (after the application step) onto which the adhesive material 17 has been applied; FIGS. 12*c*) and 13*c*) illustrate the basic article 3 (after the deposition step) onto which the powder material 21 has been applied (it can be observed that the powder material 21 overlaps slightly with respect to the adhesive material 17); and FIGS. 12*d*) and 13*d*) illustrate the basic article 3 (after the removal step) from which the excess of powder material 21 has been removed.

The object of the present invention offers several advantages with respect to the state-of-the-art. Included among these are: a reduction in waste and/or quantities to be recycled of the powder material; a reduction in the risk of varying granulometries; the possibility to obtain patterns with different colors and/or shades in a simple manner; the possibility to obtain quality patterns with good definition in a relatively uncomplicated manner.

Unless clearly stated otherwise, the contents of the references (articles, books, patent applications etc.) cited in this document are referred to integrally. In particular, the stated references are incorporated herein for reference.

The invention claimed is:

1. A method for the surface decoration of a basic article comprising ceramic material and having at least one surface, wherein the method comprises:

a conveying step, during which the basic article is conveyed along a given path through an application station, a work station, arranged downstream of the application station, and a removal station, arranged downstream of the work station;

an application step, during which a printing assembly arranged at the application station applies an adhesive material selectively in at least a defined area of the surface so that at least a further area of the surface different from the defined area is left without adhesive material;

a deposition step, during which a treatment assembly arranged in the work station deposits a powder material on the adhesive material selectively in the defined area of the surface so that the further area of the surface itself is left without powder; and a removal step, during which the powder material in excess, not bound to the adhesive material, arranged on the basic article is removed in the removal station, wherein:

the basic article being conveyed through the work station in an advancing direction; and the treatment assembly comprises:

at least a container, which is adapted to contain the powder material, and has an outlet mouth, whose longitudinal extension is transversal to the advancing direction;

a plurality of distribution members, which are arranged in series along the outlet mouth;

a plurality of actuators, each of which moves a respective distribution member between a closed position, wherein the respective distribution member blocks the passage of the powder material through the area of the outlet mouth in which it is arranged, and an open position, wherein the respective distribution member allows the passage of the powder material through the area of the outlet mouth in which it is arranged, wherein during the deposition step, said plurality of actuators moves the respective distribution members between the closed position and the open position so as to deposit the powder material on the adhesive material selectively in the defined area of the surface so that the further area of the surface itself is left without powder.

2. The method according to claim 1, wherein, during the deposition step, the treatment assembly deposits a first type of the powder material selectively in a first part of the defined area, and a second type of the powder material selectively in a second part of the defined area different from the first part of the defined area itself.

3. The method according to claim 2, wherein:

the treatment assembly deposits the first type of the powder material selectively in the first part of the defined area and not in the second part of the defined area itself; and the treatment assembly deposits the second type of the powder material selectively in the second part of the defined area and not in the first part of the defined area itself.

4. The method according to claim 2, wherein:

the first and the second type of powder material differ from each other for the color; and a conveying device conveys the basic article along the given path (P) through the application station, the work station and the removal station.

5. The method according to claim 1, wherein:

the treatment assembly deposits a first type of the powder material in at least a first part of the defined area; and the treatment assembly deposits a second type of the powder material in at least the first part of the defined area.

6. The method according to claim 1, wherein:

the powder material comprises a ceramic material; and the powder material comprises particles with sizes ranging from 50 to 500 μm.

7. The method according to claim 1, wherein:

during the application step, the printing assembly applies the adhesive material by means of the emission of at least a jet of the adhesive material;

during the removal step, the powder material in excess, not bound to the adhesive material, is removed by suction; and the printing assembly comprises an ink-jet head, which emits one or more jets of the adhesive material onto said surface.

8. The method according to claim 1, wherein:

during the application step, the printing assembly applies the adhesive material onto the surface digitally so as to reproduce a defined pattern on the surface itself;

during the deposition step, the treatment assembly deposits the powder material digitally so as to reproduce a further defined pattern on the surface; and the pattern and the further pattern coincide.

9. The method according to claim 1, wherein the adhesive material is chosen from the group consisting of:

a stable material in contact with air and at temperatures at least between 15° C. and 60° C.;

a thermoplastic material, which hardens at room temperature;

a composition with at least a component absorbable by the basic article; and a curable composition, which hardens in contact with a hardener present in the powder material, and a combination thereof;

wherein, if the adhesive material comprises a curable composition, the powder material comprises the hardener for the curable composition.

10. The method according to claim 1, wherein the adhesive material comprises a stable material, which does not significantly modify its characteristics in contact with the air and at temperatures at least between 15° C. and 60° C.

11. The method according to claim 1, wherein the adhesive material comprises a thermoplastic material, which hardens at room temperature.

12. The method according to claim 1, wherein the adhesive material comprises a composition with at least a component absorbable by the basic article.

13. The method according to claim 1, wherein the adhesive material comprises a curable composition, which hardens in contact with a hardener present in the powder material.

14. A machine for the surface decoration of a basic article comprising ceramic material and having at least a surface, wherein the machine comprises:

a conveying device for conveying the basic article along a given path through an application station;

a work station arranged downstream of the application station and a removal station arranged downstream of the work station;

a printing assembly, which is arranged at the application station and adapted to apply an adhesive material selectively in at least a defined area of the surface so that at least a further area of the surface different from the defined area is left without adhesive material;

a treatment assembly, which is arranged at the work station and adapted to deposit a powder material selectively at the defined area of the surface so that the further area of the surface itself is left without powder;

a removal device, which is arranged at the removal station and adapted to remove the powder material in excess, not bound to the adhesive material, present on the basic article;

wherein the conveying device is adapted to convey the basic article through the work station in an advancing direction;

wherein the treatment assembly comprises at least a container, which is adapted to contain the powder material and has an outlet mouth, whose longitudinal extension is transversal to the advancing direction;

a plurality of distribution members, which are arranged in series along the outlet mouth; and a plurality of actuators, each of which is adapted to move a respective distribution member between a closed position, wherein the respective distribution member blocks the passage of the powder material through the area of the outlet mouth in which it is arranged, and an open position, wherein the respective distribution member allows the passage of the powder material through the area of the outlet mouth in which it is arranged, wherein said machine further comprises a control unit configured to control the treatment assembly so that said plurality of actuators moves the respective distribution members between the closed position and the open position so as to deposit the powder material on the adhesive material selectively in the defined area of the surface so that the further area of the surface itself is left without powder.

15. The machine according to claim 14, wherein the treatment assembly comprises:

a first deposition device, which is adapted to deposit a first type of the powder material selectively in a first part of the defined area; and at least a second deposition device, which is adapted to deposit a second type of the powder material selectively in a second part of the defined area different from the first part of the defined area.

16. The machine according to claim 14, wherein the printing assembly comprises at least an ink-jet head, which is adapted to emit one or more jets of adhesive material onto said surface.

17. The machine according to claim 14, wherein the removal device comprises a suction unit for sucking the powder material in excess, not bound to the adhesive material.

18. The machine according to claim 14, wherein:

the printing assembly comprises at least two application devices, which are independent of each other and each of which is adapted to emit one or more respective jets of adhesive material onto said surface;

each application device comprises at least a respective ink-jet head.

19. The machine according to claim 14, further comprising:

a control unit, which is adapted to control the printing assembly digitally so that the printing assembly itself applies the adhesive material so as to reproduce a defined pattern on the surface;

wherein the control unit is adapted to control the treatment assembly digitally so that the treatment assembly itself deposits the powder material so as to reproduce a further defined pattern on the surface itself;

the pattern and the further pattern coincide.

* * * * *